294-906 SR
M5711 XR 4,360,230

United States Patent [19]
Wood et al.

[11] 4,360,230
[45] Nov. 23, 1982

[54] SELF LOCKING COUPLING MECHANISM FOR ENGAGING AND MOVING A LOAD

[75] Inventors: Richard L. Wood, Livermore; Alan B. Casamajor, Pleasanton; Richard E. Parsons, Orinda, all of Calif.

[73] Assignee: The United States of America as represented by the United States Department of Energy, Washington, D.C.

[21] Appl. No.: 186,886

[22] Filed: Sep. 12, 1980

[51] Int. Cl.[3] ..... B66C 1/66
[52] U.S. Cl. ..... 294/86 A; 294/83 R; 294/89
[58] Field of Search ..... 294/86 A, 89, 90, 78 R, 294/83 R, 84, 201 A; 24/230.5, 232, 241 SL, 122.3; 52/125, 698, 699, 700; 403/3

[56] References Cited

U.S. PATENT DOCUMENTS

| | | | |
|---|---|---|---|
| 3,161,930 | 12/1964 | Crosson | 24/123 |
| 3,499,676 | 3/1970 | Haeussler | 294/90 |
| 3,795,420 | 3/1974 | Preston, Jr. | 294/86 A |
| 4,173,367 | 11/1979 | Haeussler | 294/89 |

FOREIGN PATENT DOCUMENTS 2708787 7/1978 Fed. Rep. of Germany .

*Primary Examiner*—James B. Marbert

[57] ABSTRACT

Coupling mechanism (11) for engaging and lifting a load (12) has a housing (19) with a guide passage (18) for receiving a knob (13) which is secured to the load (12) through a neck (15) of smaller diameter. A hollow ball (23) in the housing (19) has an opening (27) which receives the knob (13) and the ball (23) is then turned to displace the opening (27) from the housing passage (18) and to cause the neck (15) to enter a slot (29) in the ball (23) thereby securing the load (12) to the coupling mechanism (11) as elements (49) of the housing (19) block travel of the neck (15) back into the opening (27) when the ball (23) is turned to the load holding orientation. As engagement of the load (12) and locking of the coupling mechanism are accomplished simultaneously by the same ball (23) motion, operation is simplified and reliability is greatly increased. The ball (23) is preferably turned by a motor (32) through worm gearing (36) and the coupling mechanism (11) may be controlled from a remote location. Among other uses, the coupling mechanism (11) is adaptable to the handling of spent nuclear reactor fuel elements (12).

18 Claims, 4 Drawing Figures

SELF LOCKING COUPLING MECHANISM FOR ENGAGING AND MOVING A LOAD

The U.S. government has rights in this invention pursuant to contract number W-7405-eng-48 between the U.S. Department of Energy and the University of California.

BACKGROUND OF THE INVENTION

This invention relates to load handling apparatus and more particularly to coupling devices for engaging and subsequently releasing a load which is to be lifted or otherwise manipulated.

Coupling mechanisms for temporarily connecting load handling apparatus to an object which is to be moved should in many situations be lockable to avoid an accidental release of the load. When a heavy object is to be hoisted with a cable, the consequences of an inadvertent release of the suspended object are almost invariably extremely serious. This is also true of many operations where the object is to be pulled or pushed or manipulated through a combination of movements.

Avoidance of accidental disengagement of such coupling mechanisms may be necessary for reasons other than the weight of the object which is being handled or for reasons additional to the matter of weight. Considering one specific example, procedures for the underground storage of encased radioactive wastes, such as spent reactor fuel elements, may include the lowering of such materials into a vertical shaft by means of a cable. The fuel elements are then traveled horizontally along tunnels and lowered again into the underground storage chambers. The fuel elements must be recoverable after a period of years for reprocessing of the materials. A highly complex load manipulating system is required to accomplish these motions of the materials to be stored. The coupling mechanisms which temporarily engage the load during these operations must be reliably lockable to assure that the fuel element material cannot be accidentally released during handling. Moreover in this particular context engagement and disengagement including locking and unlocking of the coupling mechanism should be controllable from a remote location as in the absence of complicated protective procedures, operating personnel should not be required to be present in the vicinity of the materials.

An advantageous device for gripping a load to be moved is a ball and knob mechanism in which a hollow ball like element of the coupler has a key hole shaped opening. The larger part of the opening receives a knob which is secured to the load through a neck of narrower dimensions than the knob. The ball is then rotated to cause the neck to move into the slot and thereby engage the load for lifting or other movement. Prior coupling mechanisms of this general kind have in some cases been provided with locking means for blocking withdrawal of the knob through the large end of the opening except when the load is to be intentionally released. As heretofore designed such locking means complicate the process of engaging and disengaging the load by requiring separate manipulations of elements additional to those which accomplish the engaging and disengaging of the load. Further the prior locking systems are readily subject to operator error and are therefore not as reliable as would be desirable.

In one prior ball and knob coupler, for example, a pin must be manually inserted into the mechanism to block release of the knob from the ball and must later be manually removed to effect disengagement. Such a system is easily subject to operator mistake and is not compatible with load handling operations which are remotely controlled. As locking requires structural elements and operator actions additional to those which serve to engage the coupler with the load, a significant risk is present that the load may be lifted or manipulated with the coupling mechanism in an unlocked or in an imperfectly locked condition.

SUMMARY OF THE INVENTION

Accordingly it is an object of the present invention to provide a coupling mechanism for engaging a load which is to be lifted or otherwise manipulated which self locks as it engages to assure against accidental release of the load.

It is an object of the invention to provide materials handling apparatus in which engaging of a load and locking against accidental release are accomplished simultaneously by the same operations.

It is an object of the invention to provide a coupling mechanism of the ball and knob form which assures against accidental release of the load but which requires no manipulative operations for such purpose other than those which effect engagement of the load.

It is still another object of the invention to provide a coupling mechanism for engaging a load which assures against accidental release of the load while being operatable and controllable from a remote location.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purposes of the present invention, as embodied and broadly described herein, a coupling mechanism for engaging a knob that is secured to a load through a neck of smaller diameter than the knob has a connector member and a turnable member journaled to the connector member for turning between a load receiving and releasing first orientation and a load holding second orientation. The turnable member has an opening for receiving the knob and a slot of lesser width than the knob into which the neck is received as the turnable member is turned to the load holding second orientation. Locking means for preventing release of the knob when the turnable member is at the load holding orientation includes a structural component on the connector member that is situated adjacent the path of movement of the opening in position to block the neck from the opening when the turnable member is at the load holding orientation.

In one aspect of the present invention, the load securing structural component is shaped to form a guide passage for guiding the knob and neck into the opening of the turnable member when the turnable member is at the first orientation. In another aspect of the invention, the neck is attached to the load through an annular shoulder of conical section configuration and the guide passage has an inner surface of similar configuration against which the shoulder seats as the knob enters the opening of the turnable member thereby immobilizing the load relative to the coupling mechanism.

In a further aspect of the present invention, control means are provided for turning the turnable member between the load receiving and releasing orientation and the load holding orientation and includes means for resisting turning of the turnable member relative to the connector member except by operation of the control means. In one specific aspect of the invention, in accordance with its objects and purposes, the control means includes a motor secured to the connector member and worm gearing coupled between the motor and the turnable member.

In still a further aspect of the invention, in accordance with its objects and purposes, the connector member is a housing having an annular internal surface of spherical segment configuration and having a knob receiving passage which extends through the internal surface. The turnable member is a ball disposed within the housing and having a spherical outer surface adjacent the internal surface of the housing and which has an interior chamber and an opening of sufficient size to admit the knob into the chamber and which further has an arcuate slot extending from the opening, the slot being of less width than the knob but of sufficient width to receive the neck as the ball is turned with the knob in the chamber. The coupling mechanism further having control means for turning the ball within the housing between a load receiving and releasing position in which the opening of the ball is aligned with the passage of the housing and a load holding position at which the opening of the ball is displaced from the housing passage.

In the preferred form, the present invention simplifies the handling of objects by mechanical means and provides greater reliability under conditions where locking of the coupling mechanism is required to assure against accidental release of the objects. The same motion of the coupling mechanism which engages the load also locks the coupling mechanism. Similarly, the same motion which releases the load also unlocks the mechanism. No additional operations are needed solely for the purpose of locking or unlocking. In one preferred form of the invention, small misalignments of the coupling mechanism and load prior to engagement are self corrected and, upon engagement, the coupling mechanism and the load are immobilized relative to each other. Where necessary, the self locking coupling mechanism is compatible with control from a remote location. Further, the coupling mechanism may be constructed to provide a device of very high strength thereby further contributing to the reliability of the coupling mechanism.

FIG. *2a–2c* are different positions of the coupling mechanisms when being fixedly attached to the fuel element.

DETAILED DESCRIPTION OF THE INVENTION

Reference will now be made in detail to the present preferred embodiment of the invention, an example of which is illustrated in the accompanying drawings.

Figure 1:
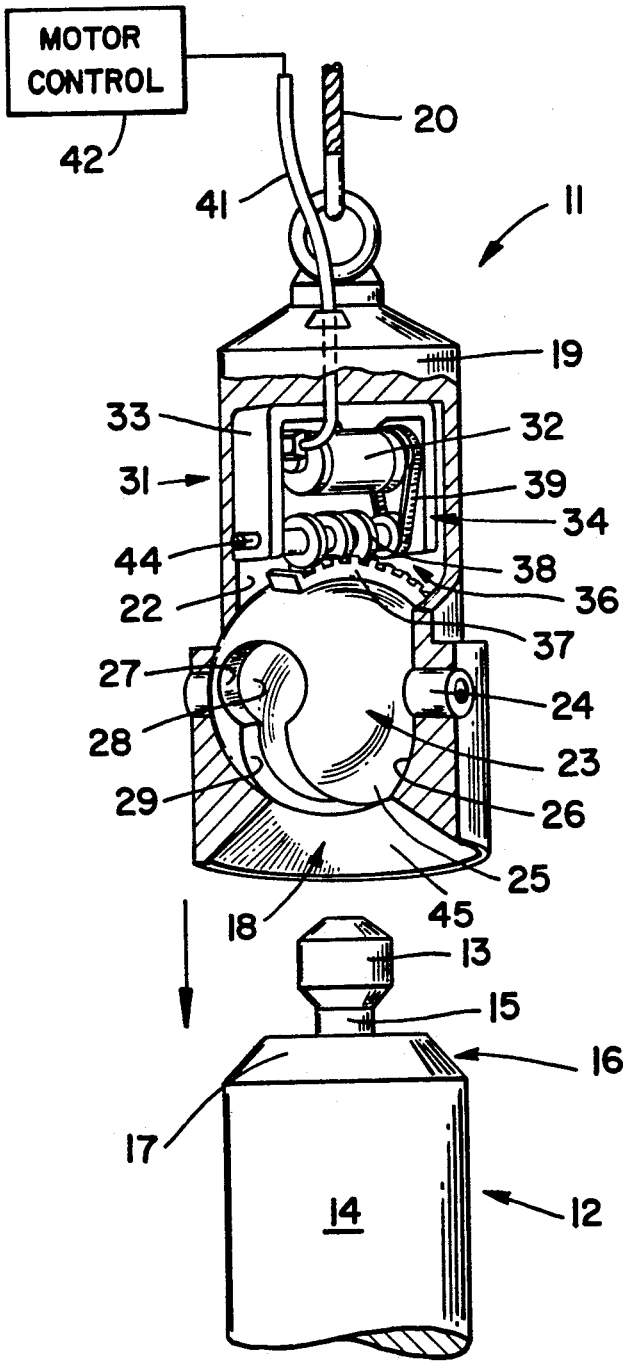
FIG. 1 is a schematic of the coupling mechanism for coupling and lifting a nuclear reactor fuel element also depicted.
Figures 2A, 2B, 2C:
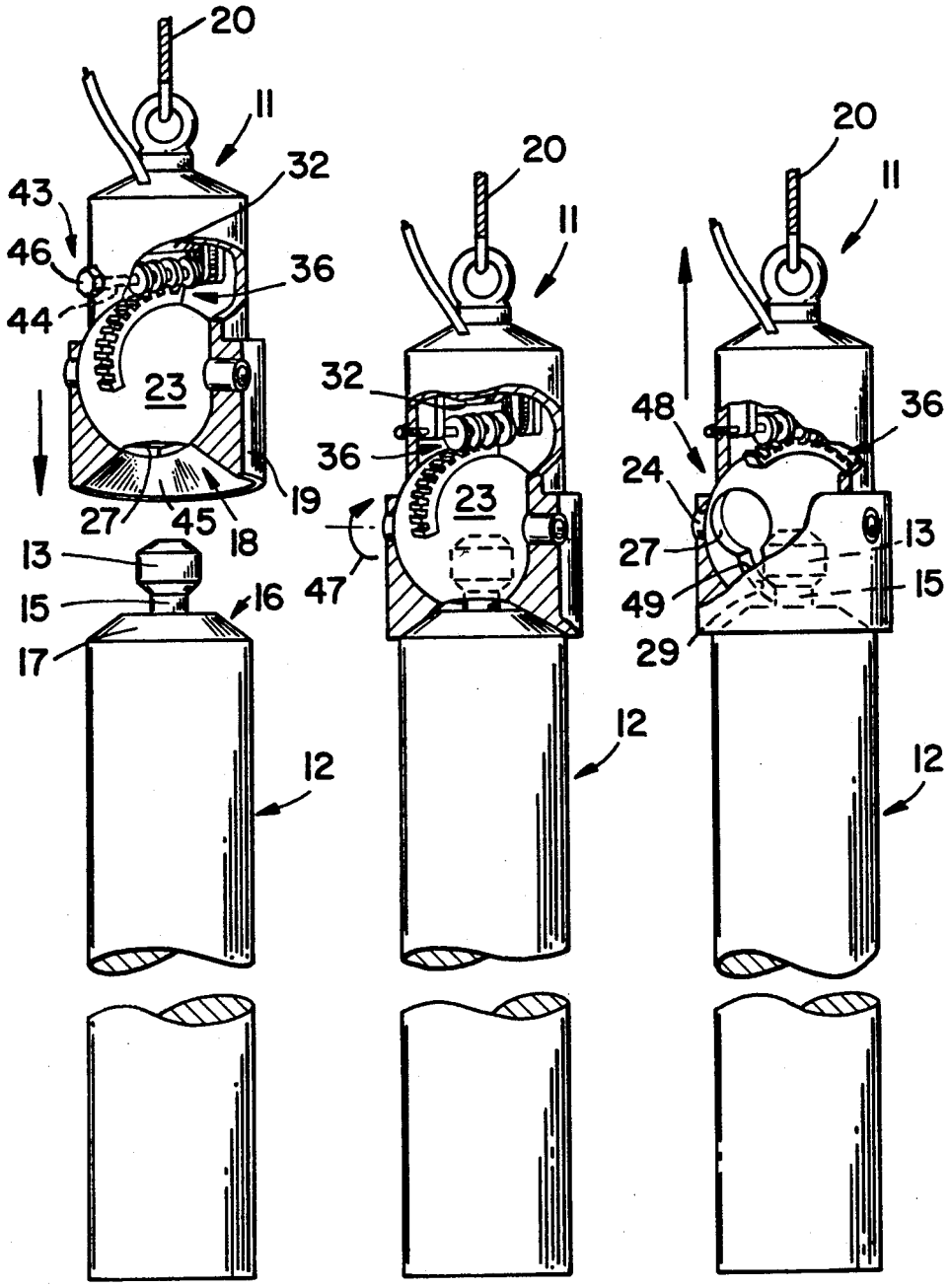

Referring initially to FIG. 1, the depicted embodiment of the invention is a coupling mechanism 11 designed for the purpose of gripping and lifting loads 12 which in this particular example are nuclear reactor fuel elements. The invention may readily be adapted to lift or otherwise manipulate a variety of other types of load such as structural concrete blocks or containerized freight among other examples.

To facilitate lifting, the load 12 is provided with a knob 13 at the upper end which is secured to the body 14 of the load through a neck 15 of less width than the knob. To immobilize the load 12 relative to the coupling mechanism 11 when it is being lifted, neck 15 is attached to the body 14 of the load through a shoulder element 16 having an annular outer surface 17 of conical section configuration and which is coaxial with neck 16 and knob 13 but of larger diameter. As will hereinafter be described in more detail, surface 17 seats in a guide passage 18 of similar configuration at the underside of the coupling mechanism 11 when the load is to be lifted.

Coupling mechanism 11 has a connector member which forms a housing 19 in this embodiment and which, in use, is secured to lifting means such as a hoist cable 20 in the present instance. Housing 19 has an internal chamber 22 in which a turnable member or ball 23 is disposed, the ball being journaled to the housing by axles 24 which enable controlled turning of the ball relative to the housing about a horizontal axis of rotation. Housing chamber 22 has an upwardly facing annular internal surface 26 of spherical section configuration adjacent the lower portion of the ball member 23 and the previously described guide passage 18 at the lower end of housing 19 extends through surface 26 so that the lower most surface 25 of the ball is accessible through passage 18.

Ball 23 has an opening 27 leading to an interior chamber 28 both of which are of sufficient size to receive knob 13. The ball 23 is further provided with an arcuate slot 29 connecting with opening 27 and which has a width smaller than the diameter of knob 13 but of sufficient size to receive neck 15. Slot 29 is oriented to remain in register with guide passage 18 as the ball is turned to shift opening 27 away from the passage 18.

The coupling mechanism 11 is provided with control means 31 for selectively turning ball 23 between a load receiving and releasing first orientation shown in FIG. *2a* and a load holding second orientation depicted in FIG. *2c*. Referring again to FIG. 1, the control means 31 of this example includes a reversible electrical motor 32 supported within the upper portion of housing chamber 22 by a inverted U-shaped support bracket 33 which is secured to the housing, the rotary axis of the motor in this example being orthogonal to the axis of rotation of ball 23. Drive transmitting means 34 are provided for coupling the motor to the ball 23 to enable selective turning of the ball between the above described orientations. The drive transmitting means 34 includes means, worm gearing 36 in this example, which resists turning of the ball 23 except by operation of the control means 31. In particular, an arcuate worm gear sector 37 is secured to ball 23 with the center of curvature of the worm gear sector being at the rotational axis of the ball. A worm 38, journaled between the arms of support bracket 33, engages rack gear 37 and is driven by motor 32 through a chain 39. Insulated electrical conductor cable 41 extends from motor 32 out of the housing 19 to connect with a remotely situated motor control 42 which may be of conventional design.

It is advantageous if the controls include supplemental drive means 43 shown in FIG. *2a* for manual operation of the coupling mechanism 11 in the event of malfunction of the motor 32. This is provided for in the present example by extending one end of the axis 44 of worm 38 to the exterior surface of housing 19 and providing an exterior element such as a hexagonal element 46 at the outer end of the axle shaft, which may be turned by a wrench or other means to enable manual engagement and disengagement of a load 12.

In operation, with reference to FIG. *2a*, lifting of the load 12 is initiated by operating motor 32 to turn ball 23 to bring the opening 27 into register with the guide passage 18 at the underside of housing 19 and by positioning the coupling mechanism 11 to locate the passage 18 directly above knob 13. The coupling mechanism 11 is then lowered to cause knob 13 to enter the ball 23 through passage 18 and opening 27 and to cause the conical surface 17 of shoulder 16 to seat against the conical inner surface 45 of passage 18. Owing to the conical configuration of guide passage 18, small misalignments of the load 12 and coupling mechanism 11 at the start of the lowering operation are tolerable and are automatically corrected.

Motor 32 is then operated to turn ball 23 in the direction illustrated by arrow 47 in FIG. *2b* which causes ball opening 27 to be displaced upwardly and away from guide passage 18 of housing 19 while neck 15 is received in slot 29 of the ball member as depicted in FIG. *2c*.

The load 12 may then be lifted and traveled horizontally or vertically if desired by manipulation of cable 20. The load 12 may be released from the coupling mechanism 11 by operating motor 32 in an opposite direction to turn ball 23 back to the load receiving and releasing orientation depicted in FIG. *2b*. Raising of the coupling mechanism 11 by means of cable 20 then releases knob 13 through opening 27 and guide passage 18 as the coupling mechanism 11 is raised away from the load 12.

The above described turning motion of ball 23 from the load receiving and releasing orientation of FIG. *2b* to the load holding position of FIG. *2c* locks or secures the load 12 to the coupling mechanism 11 without any additional mechanisms or supplementary operations being required for such purpose. The locking means 48 is inherently defined by components of the previously described structure.

In particular, with the ball 23 turned to the load holding position of FIG. *2c*, the component or portion 49 of the lower end of the housing 19 that is adjacent the path of movement of opening 27 now extends across the slot 29 of ball 23 to block travel of neck 15 into opening 27 and thus the load 12 cannot be released from the coupling mechanism 11 with the ball 23 at the load holding orientation. Housing portion 49 thus functions as a component of the locking means 48. Worm gearing 36 also contributes to the securing of the load 12 as such gearings are subject to frictional forces which inherently resist turning of the ball 23 except in response to operation of motor 32 or by manual operation of the supplemental drive means 43.

Significant motion of the load 12 other than rotation about its own axis relative to the coupling mechanism 11 itself is prevented by seating of the conical surface 17 of shoulder 16 against the conforming inner surface 45 of passage 18 of the coupling mechanism.

Unlocking of the coupling mechanism 11 is also automatic and is inherently brought about by the motion of the ball 23 from the load holding orientation depicted in FIG. *2c* back to the load receiving and releasing position shown in FIG. *2b*. Such motion travels the neck 15 back along slot 29 and into opening 27 enabling knob 13 to withdraw from the coupling mechanism 11 as it is raised by cable 20.

The foregoing description of a preferred embodiment of the invention has been presented for purposes of illustration and description. It is not intended to be exhaustive or limit the invention to the precise form disclosed, and obviously modifications and variations are possible in light of the above teachings. The embodiment was chosen and described in order to best explain the principle of the invention and its practical application to thereby enable others skilled in the art to best realize the invention in various embodiments and with various modifications as are suited to the particular use contemplated. It is intended that the scope of the invention be defined by the claims appended hereto.

We claim:

1. Coupling mechanism for engaging a knob that is secured to a load through a neck of smaller diameter than the knob, the mechanism having a connector member and a turnable member journaled to said connector member for turning between a load receiving and releasing first orientation and a load holding second orientation, the turnable member having an opening for receiving said knob and having a slot of lesser width than said knob into which said neck is received as said turnable member is turned to said load holding second orientation, the coupling mechanism including locking means for preventing release of said knob when said turnable memer is at said load holding second orientation thereof, wherein said locking means includes a structural component on said connector member situated adjacent the path of movement of said opening in position to block said neck from said opening when said turnable member is turned to said holding second orientation, and control means for selectively turning said turnable member between said orientations thereof and means for resisting turning of said turnable member except by operation of said control means, said control means including a motor secured to said connector member and drive transmitting means for turning said turnable member between said orientations thereof by operation of said motor.

2. Coupling mechanism as set forth in claim 1 wherein said structural component on said connector member forms part of a guide passage for guiding said knob and neck into said opening of said turnable member when said turnable member is at said first orientation thereof.

3. Coupling mechanism as set forth in claim 2, said neck being attached to said load through an annular shoulder of conical section configuration, wherein said guide passage has an annular inner surface of similar configuration against which said shoulder seats as said knob enters said opening of said turnable member.

4. Coupling mechanism as set forth in claim 1 further including supplemental drive means for manually operating said drive transmitting means.

5. Coupling mechanism as set forth in claim 1 wherein said drive transmitting means comprises worm gearing coupled between said motor and said turnable member.

6. Coupling mechanism as set forth in claim 1 further including an arcuate worm gear sector secured to said turnable member with the center of curvature of said arcuate worm gear sector being coincident with the axis of rotation of said turnable member, a worm journaled to said connector member and engaged with said worm gear sector, and a motor carried by said connector member and being coupled to said worm to drive said worm.

7. Coupling mechanism as set forth in claim 6 wherein said motor is a reversible electrical motor, further including means for controlling said motor from a remote location.

8. Coupling mechanism as set forth in claim 1 wherein said connector member is a housing having an internal surface conforming to a portion of a sphere and having a passage extending through said internal surface through which said knob enters said housing, and wherein said turnable member is a ball situated within said housing and having a spherical outer surface adjacent said spherical internal surface of said housing, said opening of said turnable member being aligned with said passage of said housing when said turnable member is at said load receiving and releasing orientation and being displaced from said passage of said housing when said turnable member is turned to said load holding orientation.

9. Coupling mechanism as set forth in claim 8 wherein said knob and said neck are secured to said load through a conical element, and wherein said passage of said housing has a conforming conical configuration positioned to receive and seat said conical element when said knob is received into said opening of said turnable member whereby said load is immobilized relative to said coupling mechanism when said turnable member is in said load holding orientation.

10. The coupling mechanism as defined in claim 1, additional including means operatively connected to said connector member for lifting said coupling mechanism.

11. Coupling mechanism for engaging a load which is to be lifted, the load having a knob secured thereto through a neck of smaller diameter than the knob, comprising:

a housing having an annular internal surface of spherical segment configuration and having a knob receiving passage which extends through said internal surface, a turnable ball member disposed within said housing and having a spherical outer surface adjacent said internal surface of said housing, said ball member having an interior chamber and an opening of sufficient size to admit said knob into said chamber and further having an arcuate slot extending from said opening and which is of less width than said knob but of sufficient width to receive said neck as said ball member is turned with said knob in said chamber, and control means for turning said ball member within said housing between a load receiving and releasing position at which said opening of said ball member is aligned with said passage of said housing to receive said knob therethrough and a load holding position at which said opening of said ball member is displaced from said passage of said housing and said slot is adjacent said passage, said control means including an arcuate work gear sector secured to said ball member, a worm journaled with said housing and engaged with said work gear sector, and a reversible motor secured to said housing and being coupled to said worm to drive said worm gear sector and thereby turn said ball member between said positions thereof.

12. Coupling mechanism as defined in claim 11 further comprising means for manually rotating said worm.

13. Coupling mechanism as defined in claim 11 wherein said knob and neck are attached to said load through a shoulder element and wherein said passage of said housing has a configuration conforming to the outer surface of said shoulder element in order to receive and seat said shoulder element when said knob is in said interior chamber of said ball member.

14. The coupling mechanism as defined in claim 11, additionally including means connected to said housing for lifting said coupling mechanism.

15. A coupling mechanism for remotely handling loads comprising:

a housing defining a chamber therein, said housing being provided with lifting means at one end and with a guide passage at the opposite end, said guide passage including an outwardly extending conical surface;

a turnable member rotatably mounted in said chamber of said housing, said turnable member having an opening therein on a slot extending from said opening, said opening having a cross-section greater than a cross-section of said slot;

means located in said chamber of said housing operatively connected to said turnable member for at least partially rotating same; and control means operatively connected to said turnable member rotating means for selectively activating said rotating means causing selective rotation of said turnable member;

whereby said turnable member may be positioned in a load receiving and releasing orientation such that said opening in said turnable member is in alignment with said guide passage of said housing, or said turnable member may be positioned in a load holding orientation such that a portion of said slot in said turnable member is in alignment with said guide passage of said housing.

16. The coupling mechanism of claim 15, wherein said means for at least partially rotating said turnable member includes:

a worm gear sector secured to said turnable member, a worm gear engaged with said worm gear sector, and means for rotating said worm gear.

17. The coupling mechanism of claim 16 wherein said means for rotating said worm gear comprises a reversible electric motor operatively connected to said worm gear.

18. The coupling mechanism of claim 16, wherein said means for rotating said worm gear comprises a manually driven member operatively connected to said work gear.

* * * * *